United States Patent [19]

Dodge

[11] 4,391,263

[45] Jul. 5, 1983

[54] BOWSTRING RELEASE DEVICE

[76] Inventor: Paul A. Dodge, Rte. 3, Menomonie, Wis. 54751

[21] Appl. No.: 245,355

[22] Filed: Mar. 19, 1981

[51] Int. Cl.[3] ..... F41B 5/00

[52] U.S. Cl. ..... 124/35 A

[58] Field of Search ..... 124/35 A, 23 R, 24 R, 124/41 A

[56] References Cited

U.S. PATENT DOCUMENTS

| | | | |
|---|---|---|---|
| 3,845,752 | 11/1974 | Barner . | |
| 3,929,120 | 12/1975 | Barner | 124/35 A |
| 3,937,206 | 2/1976 | Wilson | 124/35 A |
| 4,004,564 | 1/1977 | Castonguay . | |
| 4,022,181 | 5/1977 | Fletcher | 124/35 A |
| 4,169,455 | 10/1979 | Wilson . | |
| 4,170,216 | 10/1979 | Wilson . | |

*Primary Examiner*—Richard C. Pinkham
*Assistant Examiner*—Matthew Schneider
*Attorney, Agent, or Firm*—Burd, Bartz & Gutenkauf; Burd, Bartz & Gutenkauf

[57] ABSTRACT

A mechanical bowstring release device of the type having a trigger mechanism including a latch rotatable upon actuation of the trigger to release a drawn bowstring. A release device body has an interior cavity containing the bowstring latch member. The latch member is connected to a trigger which extends through a trigger opening from the cavity to a location outside the body portion. The latch member has an arcuate lateral rib. The cavity has corresponding arcuate grooves. The rib of the latch member is assembled in the grooves in the cavity for rotation of the latch member between a bowstring holding position and a bowstring release position.

27 Claims, 12 Drawing Figures

BOWSTRING RELEASE DEVICE

SUMMARY OF THE INVENTION

In the field of archery, it is common for an archer to employ a mechanical bowstring release device for purposes of comfort and accuracy. Typical prior art devices employ a latch mechanism which in a cocked configuration is operable to hold the bowstring in drawn relationship to a bow. Upon release of the catch, typically by movement of a trigger, the catch releases the bowstring. The catch generally includes a rotating element having a finger or notch or like holding element forming a seat which holds the bowstring in the drawn position. The holding element engages either the bowstring itself or it engages a draw cord loop which in turn is wrapped around the bowstring. Release of the catch permits rotation of the holding element to release the bowstring. In the drawn configuration, the bowstring can exert a good deal of force. The brunt of this force is borne by the holding element. This frequently leads to failure of one type or another of these prior art devices.

The present invention relates to a mechanical bowstring release device of the type having a trigger mechanism including a latch rotatable upon actuation of the trigger to release a drawn bowstring. The release device includes a body having a cavity containing the bowstring latch member of the trigger mechanism. The latch member is connected to a trigger which extends through a trigger opening from the cavity to a location outside the body portion. When holding a drawn bowstring, manual manipulation of the trigger results in rotation of the latch member to release the bowstring. The latch member has a normally rearwardly facing shoulder extending through a latch opening opposite the trigger opening on the body portion. The shoulder provides a seat for retention of a bowstring or a cord loop which in turn retains a drawn bowstring. The seat provided by the shoulder is located very close to the axis of rotation of the latch member whereby the force and torque exerted by the drawn bowstring are more readily transmitted through the bowstring release device itself rather than being entirely borne by the latch member. The cavity in the body portion has arcuate grooves. The latch member has an arcuate rib assembled in the arcuate grooves of the body. The latch member is rotatable in the cavity between the bowstring holding position and the bowstring release position about an axis perpendicular to the intended path of travel of the arrow with the rib on the latch member moving in the grooves provided in the body portion cavity. Force borne by the latch member is thus more fully transmitted through the body portion. In one form of the invention, the trigger mechanism provides a latch member which is retained in position by a trigger and is allowed to rotate when the trigger is rotated out of the way of the latch member. In another form of the invention, the latch member and the trigger are integral whereby rotation of the trigger of the trigger mechanism results in corresponding rotation of the latch member to effect release of a cord loop retaining a bowstring.

IN THE DRAWINGS

DESCRIPTION OF PREFERRED EMBODIMENTS

Figure 1:
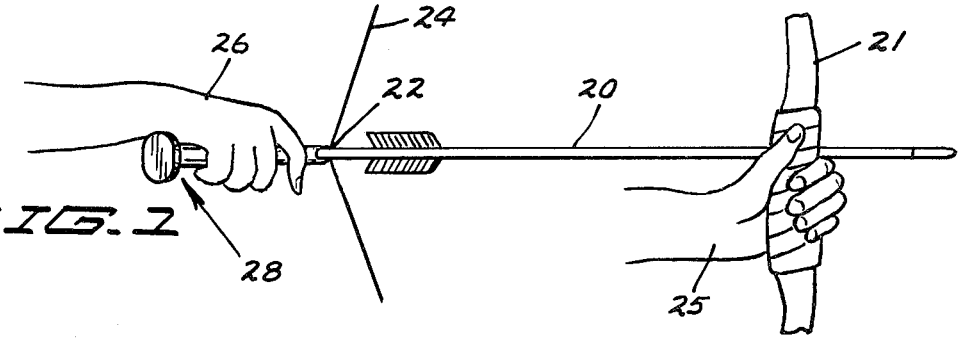
FIG. 1 is a side elevational view of an arrow in drawn relationship to a bow, the bowstring being drawn by an archer using a bowstring release device according to one form of the invention.
Figure 2:
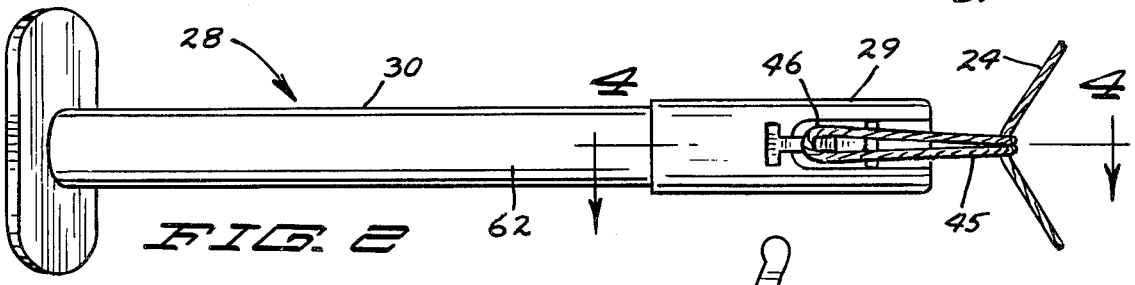
FIG. 2 is an enlarged side elevational view of the bowstring release device of FIG. 1.
Figure 3:
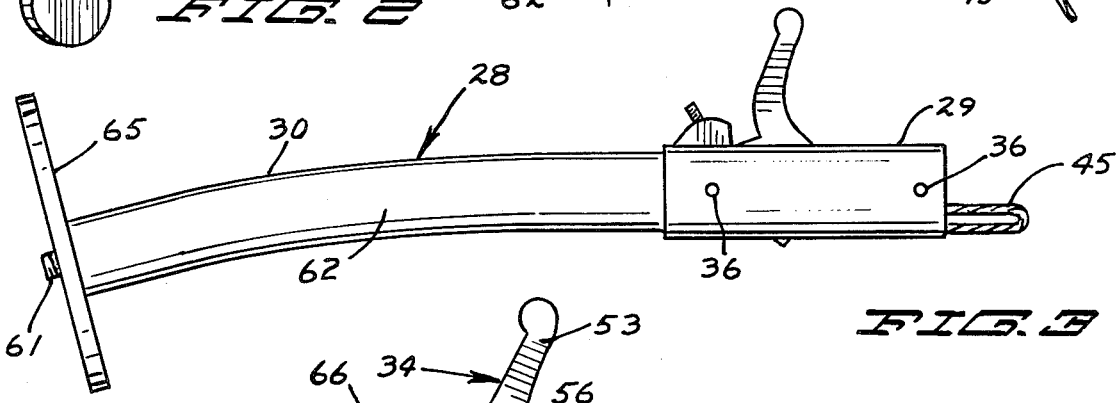
FIG. 3 is an enlarged top plan view of the bowstring release device of FIG. 1.

Referring to the drawings, there is shown in FIG. 1 an arrow 20 set and drawn in a bow 21, the nock 22 of the arrow engaging the bowstring 24 in conventional manner. Bow 21 and bowstring 24 generally defined a bowstring plane. The left hand 25 of an archer is forwardly extended and siezes the forward portion or grip of bow 21. The right hand 16 of the archer engages a release device 28 according to one embodiment of the invention. Release device 28 engages a portion of bowstring 22 and is drawn rearward to a position shown in FIG. 1 preparatory to release and discharge of the arrow 20.

Figure 4:
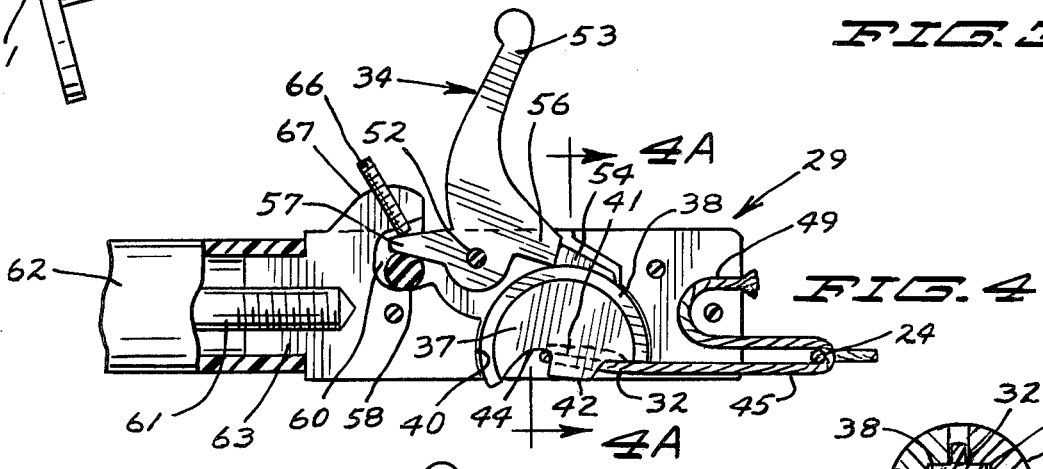
FIG. 4 is an enlarged sectional view of a portion of the bowstring release device of FIG. 2 taken along the line 4—4 thereof.
Figure 4A:
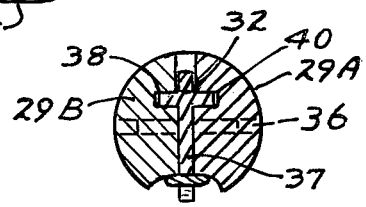
FIG. 4A is a sectional view of a portion of the bowstring release device of FIG. 4 taken along the line 4A—4A thereof.

As shown in FIGS. 2 through 5, release device 28 includes a generally cylindrical forward body portion 29 and an elongate rearwardly extended handle 30. A trigger mechanism is assembled within body portion 29 for drawing, holding and releasing a bowstring. Body portion 29 has an interior cavity 32 with a latch opening and a trigger opening. Cavity 32 houses portions of the trigger mechanism including a latch member 33 and a trigger 34. As shown in FIG. 4A, body portion 29 can be formed of mating pieces 29A, 29B to which have complimentary recesses that come together to form cavity 32 and are held together as by bolts 36. Latch member 33 is comprised as a segmented circular member having a flat central base or web 37 and a peripheral outwardly extended segmented arcuate rib 38. Peripheral rib 38 extends in generally perpendicular relationship to the plane of web 37 on either side of web 37. Interior cavity 32 is shaped to closely correspond to the outer peripheral shape of the latch member 33. Cavity 32 has complimentary segmented arcuate grooves 40 corresponding in shape to the rib 38 of latch member 33. Rib 38 is assembled in grooves 40 for rotation of latch member 33 in cavity 32 about an axis indicated generally at 41 in FIGS. 4 and 5 with rib 38 riding in the grooves 40.

Figure 5:
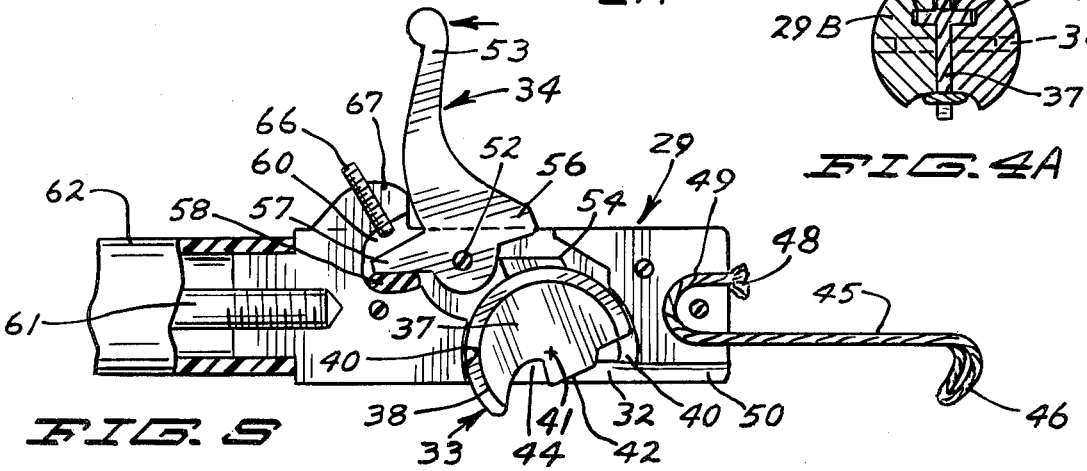
FIG. 5 is a sectional view of the bowstring release device like that of FIG. 4 but showing the trigger mechanism in the bowstring release position.

Latch member 33 has a rearwardly facing shoulder 42 constituted as an integral extension of web 37 extending through the latch opening to cavity 32 on one side of body portion 29. Shoulder 42 forms a retaining seat 44 for retention of a bowstring draw cord. In the cocked position of FIG. 4, shoulder 42 faces opposite the intended path of travel of the arrow whereby a bowstring draw cord is securely situtated in the seat 44. Upon release of the latch member, shoulder 42 is forwardly rotated to a position where seat 44 permits release of a bowstring draw cord. As shown in FIGS. 4 and 5, seat 44 is located proximate the axis of rotation 41 of the latch member 33. Force of a drawn bowstring exerted at seat 44 is thus more evenly distributed throughout the latch member 33 and, by virtue of the rib 38, through the body portion 29. The likelihood of failure through the latch member 33 occasioned by the force of a drawn bowstring is greatly reduced.

A bowstring draw cord 45 is assembled to the forward end of body portion 29 and has a free end loop 46 for releasable attachment to latch member 33. Fixed ends 48 of draw cord 45 are trained through a C-shaped forwardly facing slot 49 at the forward end of body portion 29 and are fixed therein by suitable means. For example, draw cord 45 can be formed of a synthetic plastic fiber and the ends 48 can be seared and thereby enlarged to prevent their passage through slot 49. A longitudinal recess 50 extends along body portion 29 from the forward tip thereof to the latch opening of cavity 32. In the cocked position shown in FIG. 4, draw cord 45 lies in the recess 50 with end loop 46 trained about shoulder 42 and situtated in cord retaining seat 44 forming an intermediate loop for engagement about the bowstring 24.

Draw cord 45 and latch member 33 are held in the cocked position of FIG. 4 by trigger 34. Trigger 34 is pivotally assembled in cavity 32 for pivotal rotation about a pin 52. Trigger 34 has a digitally engagable finger 53 extending through the trigger opening of cavity 32. Latch member 33 has a catch 54 extended radially outward from rib 38. Trigger 34 has a sear 56 rotatable into and out of engagement with catch member 54 upon rotation of finger 53.

An arm 57 extends rearwardly on trigger 34 away from pivot pin 52 and is in contact with a compression spring element comprised as an elastically deformable rubber ball 58. Ball 58 is situated in a recess 60 in cavity 32 and bears between the end of arm 57 and an interior wall of cavity 32. Wall 58 biases the trigger 34 toward the cocked position of FIG. 4. Trigger 34 is rotatable against the bias of ball 58.

Handle 30 includes an elongate stem 61 having an end threaded into the rearward end of the body portion 29. A tubular hose like handle grip 62 surrounds stem 61. One end of grip 62 is telescopically engaged over a reduced portion 63 of the end of body portion 29. Stem 61 extends beyond the opposite end of grip 62. A plate or stock 65 is threaded on the opposite end of stem 61. Grip 62 can be manually held by an archer while bowstring release device 28 is drawn rearwardly. Stock 65 prevents slippage of the hand off of the grip 62.

In use of the bowstring release device, with an arrow 20 properly situtated with respect to a bow 21 and the trigger assembly in the cocked position of FIG. 4, bowstring draw cord 45 is wrapped around the bowstring 24 and the loop end thereof is situtated in the seat 44 of latch member 33. Sear 56 of trigger 34 is in engagement with the catch 54 of latch member 33 thus to prevent rotation of the latch member 33 responsive to the force of a drawn bowstring. In the cocked position, the release device is drawn rearwardly to draw the bowstring rearwardly. The force of the drawn bowstring is transmitted through the rib 38 of latch member 33 to the body portion 29. Since the seat 44 is located close to the axis of rotation 41 of latch member 33, latch member 33 does not experience an undue amount of torque occasioned by the force of the drawn bowstring. At the proper time to effect release of the arrow, the archer applies digital pressure on the finger 53 of trigger 34. This rotates trigger 34 to a position where the sear 56 moves out of engagement with the catch 54 permitting rotation of latch member 33. Shoulder 42 is rotated to a position shown in FIG. 5 whereby release of the end loop 46 of draw cord 45 is permitted. This releases bowstring 24 and consequently the arrow 20.

The amount of rotation of trigger 34 needed to release latch member 33 is adjustable. An elongate set screw 66 is threaded through an enlargement 67 of body portion 29 and has an interior end abutting against the arm 57 of trigger 34 inhibiting forward rotation of trigger 34. The location of the interior end set screw 66 determines the amount of forward rotation permitted of trigger 34. Adjustment of the position of the set screw 66 can be made such that very little rotation of trigger 34 in a rearward direction is needed to release the catch 54 of latch member 33. Outward movement of set screw 66 permits a greater measure of forward rotation of trigger 34 in the cocked position whereby a greater amount of rotation of trigger 34 is necessary in order to effect release of catch 54.

Figure 7:
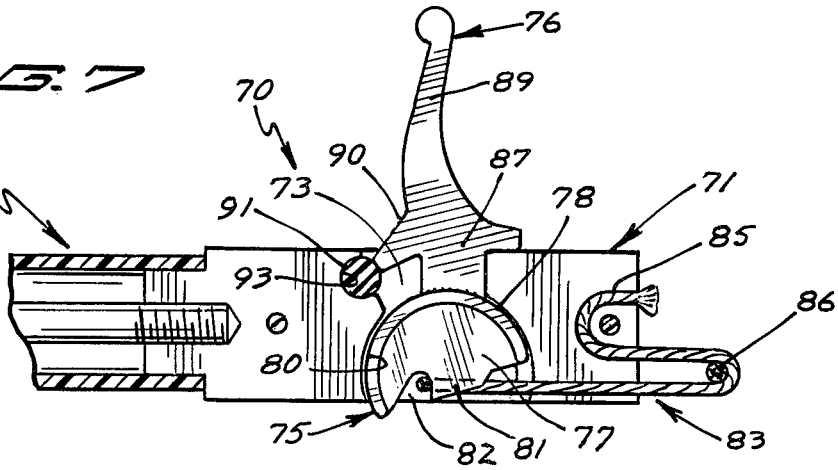
FIG. 7 is a side elevational view in section of a bowstring release device showing a second form of the invention.
Figure 8:
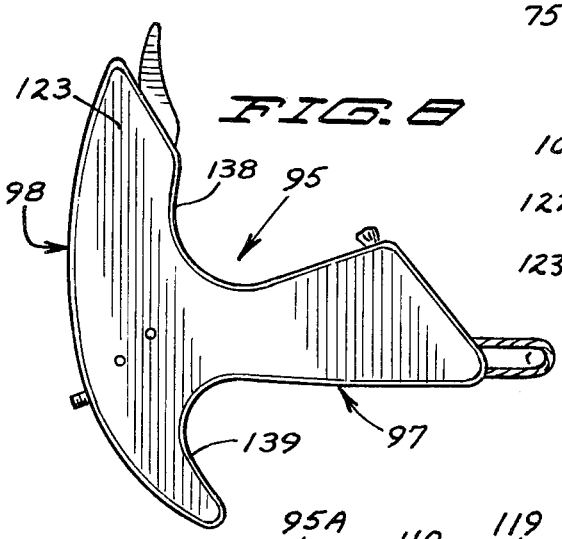
FIG. 8 is a top plan view of a bowstring release device according to a third form of the invention.

A second form of the invention indicated generally at 70 in FIG. 7 is similar to the form of the invention shown in FIGS. 1 through 6 having a generally cylindrical body portion 71 and an elongate rearwardly extended handle 72. Body portion 71 has an interior chamber or cavity 73 having a trigger opening on one side of body portion 71 and a latch opening on another. A trigger mechanism includes a latch member 75 connected to a trigger 76 assembled in the cavity 73. Latch member 75 is constituted as a segmented arcuate member having an interior web 77 and an outer peripheral segmented arcuate rib 78. Cavity 73 has a segmented arcuate grooves 80 which correspond in shape to and accommodate the rib 78 of latch member 75. Latch member 75 is rotatable in the cavity 73 with the rib 78 riding in the grooves 80. A shoulder 81 extends outwardly from the web 77 of latch member 75 defining a rearwardly facing seat 82. A bowstring draw cord 83 has ends assembled in a C-shaped slot 85 located at the forward portion of body portion 71. The loop end of draw cord 83 can be inserted in the seat 82 of latch member 75 while retaining a segment of a bowstring 86.

Trigger 76 is integrally connected to latch member 75 for rotation therewith about the axis of rotation of latch member 75. Trigger 76 has one end 87 integrally connected to rib 78 of latch member 75 and extending through the trigger opening to cavity 73 terminating in a digitally engagable finger 89. An arm 90 extends rearwardly from finger 89 and is in contact with a bias element constituted as a rubber ball 91 situtated in a recess 93 of cavity 73. Rubber ball 91 biases the trigger finger 89 in a cocked position as shown in FIG. 7. The moment exerted on the shoulder 81 by the draw cord 83 is small since the seat 82 is located near the center of rotation of latch member 75. The bias provided by the ball 91 on trigger finger 89 is sufficient to overcome the moment exerted by draw cord 83. Rearward digital pressure on the trigger finger 89 against the bias of the rubber ball 91, compressing the rubber ball 91, is effective to rotate the latch member 75 to a position where shoulder 81 is rotated such that seat 82 permits release of draw cord 83 to thereby release bowstring 86. Release of digital pressure upon the trigger finger 89 results in returning of the latch member 75 to the hold or cocked position.

Figure 9:
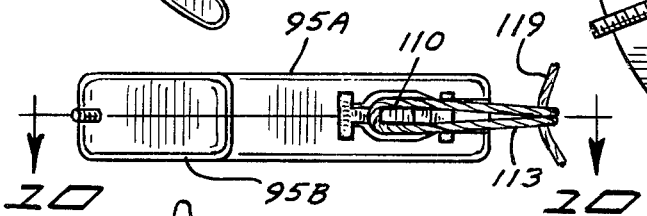
FIG. 9 is a side elevational view of the bowstring release device of FIG. 8.

A third form of the bowstring release device of the invention is shown in FIGS. 8 through 11 and is indicated generally at 95. Release device 95 includes a housing having a body portion 97 and an integral handle 98. A trigger mechanism is assembled in body portion 97 for drawing, holding and releasing a bowstring. Body portion 97 has an interior chamber or cavity 99 with a latch opening 101. Cavity 99 extends into handle 98 and has a trigger opening 102. The trigger mechanism includes a latch member 103 and a trigger 105. As shown in FIG. 9, a housing of release device 95 can be formed of mating pieces 95A, 95B which have complimentary recesses that come together to form the cavity 99. Latch member 103 is comprised as a segmented circular member having a flat central base or web 106 and a peripheral outwardly extended segmented arcuate rib 107. Interior cavity 99 is shaped to closely correspond to the outer peripheral shape of latch member 103. Cavity 99 has complimentary segmented arcuate grooves 109 corresponding in shape to the rib 107 of latch member 103. The rib 107 is assembled in the grooves 109 for rotation of latch member 103 in cavity 99 proximate latch opening 101 with rib 107 riding in grooves 109.

Latch member 103 has a rearwardly facing shoulder 110 constituted as an integral extension of web 106 extending through the latch opening 101 of cavity 99 on one side of body portion 97. Shoulder 110 forms a retaining seat 111 for retention of a bowstring draw cord. In the cocked position of FIG. 10, shoulder 110 faces opposite the intended path of travel of an arrow whereby a bowstring draw cord is securely situtated in seat 111. Upon release of the latch member, shoulder 110 is forwardly rotated to a position where seat 111 permits release of a bowstring draw cord. Seat 111 is located proximate the axis of rotation of the latch member 103. Force of a drawn bowstring exerted at seat 111 is thus more evenly distributed throughout the latch member 103 and, by virtue of the lateral rib 107, throughout the body portion 97.

A bowstring draw cord 113 is assembled to the forward end of body portion 97 and has a free end loop 114 for releasable attachment to latch member 103. Fixed ends 115 of draw cord 113 are trained through a slot 117 at the forward end of body portion 97. Ends 115 are fixed with respect to the slot 117 so as to prevent passage through the slot. A longitudinal recess 118 extends from the tip of body portion 97 to the latch opening 101 of cavity 99. In the cocked position shown in FIG. 10, draw cord 113 lies in the recess 118 with the end loop 114 trained around shoulder 110 and situtated in the cord retaining seat 111 forming an intermediate loop for engagement about a bowstring 119.

Figure 10:
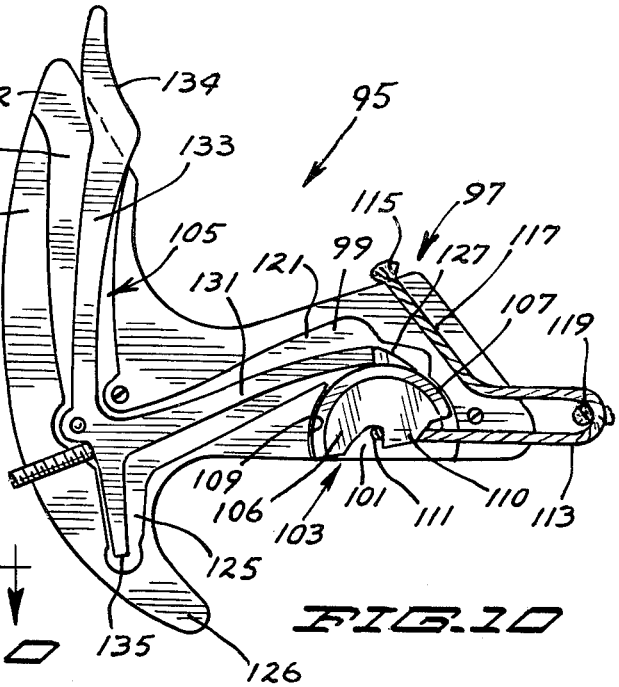
FIG. 10 is an enlarged sectional view of the bowstring release device of FIG. 9 taken along the section 10—10 thereof and showing the trigger mechanism in the bowstring retaining position.
Figure 11:
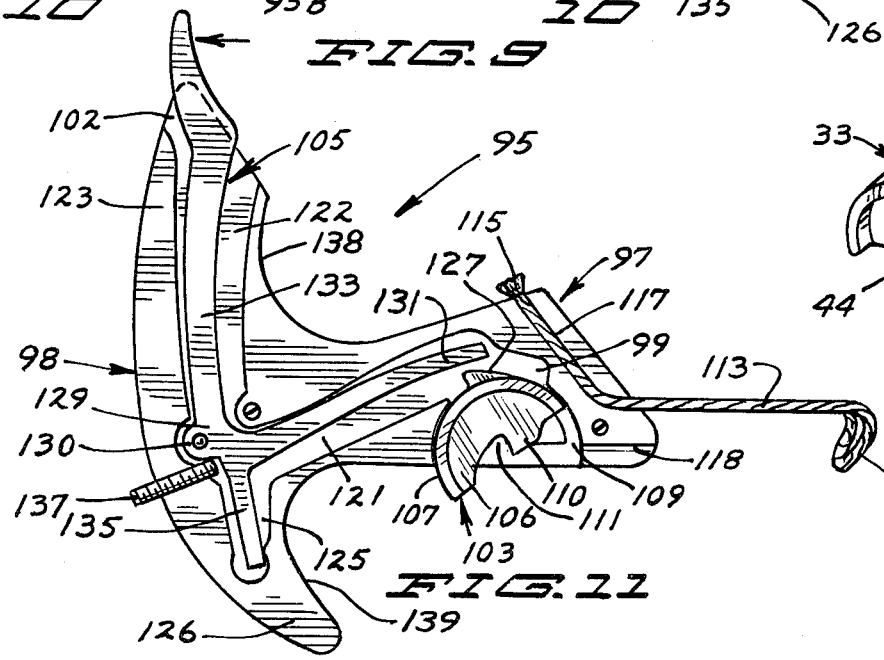
FIG. 11 is a sectional view of a bowstring release device like that of FIG. 10 showing the trigger mechanism in the bowstring release position.
Figure 6:
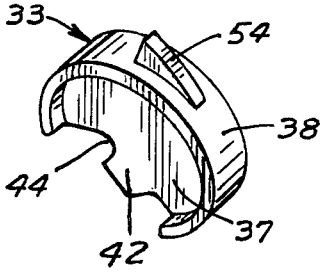
FIG. 6 is a perspective view of the latch element of the bowstring release device of FIGS. 1 through 5.

Draw cord 113 and latch member 103 are held in the cocked position of FIG. 10 by trigger 105. Cavity 99 includes a first passage 121 extending from latch opening 101 rearwardly through body portion 97. First passage 121 intersects a second generally lateral passage 122 extended through a first lateral arm 123 of handle 98 and terminating at trigger opening 102. A third passage 125 extends from the interior end of first passage 121 in a direction generally opposite the second passage 102 through a second lateral arm 126 of handle 98, terminating therein.

Latch member 103 has a rearwardly directed catch 127 extended radially from lateral rib 107. Trigger 105 has a central portion 129 fixed by a pin 130 in the vicinity of the intersection of the passages 121, 122, 125. An elongate flexible sear 131 extends from the central portion 129 of trigger 105 through the first passage 121. The end of sear 131 is positioned in holding relationship to catch 127 of latch member 103 in the cocked position, preventing rotation of latch member 103 to the release position. An elongate flexible trigger finger 133 extends from central trigger portion 129 through the second passage 122 extending outwardly of trigger opening 102 and terminating in a digitally engagable tip 134. Rearward deflection of tip 134 results in flexure of trigger finger 133 and corresponding flexure of sear 131 to move the tip of sear 131 out of holding engagement with catch 127 of latch member 103.

A leg 135 extends from central portion 129 of trigger 105 into the third passage 125. Upon deflection of the trigger finger 133 and sear 131, leg 135 is also deflected to a point where it engages the walls defining passage 125. Pressure of the leg 135 against the interior wall of passage 125 provides a bias force in addition to the flexure force of finger 133 tending to return the trigger 105 to the unflexed position.

First arm 123 and second arm 126 of handle 98 together with body portion 97 form a generally T-shaped housing for release 95. First arm 123 has a forwardly facing finger engagable contour 138 and the second arm 126 has a forwardly facing finger engagable contour 139 to be grasped by the archer.

In use, release device 95 is cocked as shown in FIG. 10 with the sear 131 of trigger 105 in engagement with catch 127 of latch member 103 thereby preventing rotation to the released position. Draw cord 113 is wrapped around a bowstring 119 with a loop end thereof 114 positioned about the shoulder 110 and situtated in the seat 111. In such configuration, bowstring 119 is drawn back preparatory to release of an arrow. Upon proper time for release of the arrow, digital pressure is applied to the tip 134 of trigger finger 133 to deflect it rearwardly. This results in a corresponding deflection of the sear 131 to a position out of engagement with the catch 127 shown in FIG. 11. The force upon the shoulder 110 occasioned by the drawn bowstring 119 causes rotation of latch member 103 to the released position, thus releasing the draw cord 113 and the arrow (not shown). Upon release of digital pressure on the tip 134, the flexed trigger finger and sear return to the original position where upon by rotation of the latch member back to the original position, the release device is once again cocked. While as shown, latch member 103 engages a bowstring draw cord, it is apparent that the latch member could engage the bowstring itself.

The amount of deflection needed for release of the latch member 103 is adjustable whereby the release device can be adjusted to provide a "hair" trigger on the one hand, or it can be adjusted whereby a greater amount of deflection is needed in order to release the draw cord. A set screw 137 is threaded through the handle arm 126 into passage 125 to a location where it bears against the leg 135. Inward rotation of the set screw 137 results in movement of the starting position of the leg 135 and also that of the sear 131 such that a smaller amount of additional movement is required for release of the catch 127. Rotation of the set screw 137 in an outward direction results in a greater amount of rotation needed in order for the sear 131 to be moved to a position of release with respect to the catch 127 of the latch member 103.

While there have been shown and described certain preferred embodiments of bowstring release devices according to the invention, it will be apparent that certain deviations and alterations can be had without departing from the scope and spirit of the invention.

The embodiments of the invention in which an exclusive property or privilege is claimed are defined as follows:

1. A bowstring release device useable by an archer in conjunction with an arrow and a bowstring mounted on a bow to effect release of the bowstring to discharge the arrow along an intended forward longitudinal path of travel, said device comprising:

a housing having interior walls defining an interior cavity with a latch opening and a trigger opening;

a latch member having a generally flat central base located in the cavity for rotation about an axis generally perpendicular to the intended longitudinal path of travel of the arrow and having a generally segmented circular arcuate rib portion outwardly extended from both sides of the base in a direction parallel to said axis of rotation;

said interior walls defining said cavity shaped to closely conform to the latch member and having generally segmented circular arcuate groove means on both sides of the base located to define the path of travel of the rib portion of the latch member upon rotation of the latch member in the cavity, said rib portion of the latch member being movably located in said groove means to support the latch member and to guide rotation of the latch member about said axis generally perpendicular to the intended longitudinal path of travel of the arrow;

said latch member having a generally rearwardly facing shoulder accessible through the latch opening defining a cord retaining seat rotatable between a cord retaining position and a cord release position upon rotation of the latch member;

trigger means in said cavity having a trigger finger extended through the trigger opening for engagement and movement by an archer, said trigger means operatively connected to the latch member for rotation of the latch member from the cord retaining position to the cord release position upon movement of the trigger finger; and handle means connected to the housing.

2. A bowstring release device useable by an archer in conjunction with an arrow and a bowstring mounted on a bow to effect release of the bowstring to discharge the arrow along an intended forward longitudinal path of travel, said device comprising:

a housing having interior walls defining an interior cavity with a latch opening and a trigger opening;

a latch member having a generally flat central base located in the cavity for rotation about an axis generally perpendicular to the intended longitudinal path of travel of the arrow, and having a generally segmented circular arcuate rib portion outwardly extended from both sides of the base in a direction parallel to said axis of rotation;

said interior walls defining said cavity shaped to closely conform to the latch member and having a generally segmented circular arcuate groove means on both sides of the base located to define the path of travel of the rib portion of the latch member upon rotation of the latch member in the cavity, said rib portion being supported and movably located in the groove means to guide rotation of the latch member about said axis;

said latch member base having a generally rearwardly facing shoulder accessible through the latch opening and defining a cord retaining seat rotatable between a cord retaining position with the shoulder in the rearwardly facing position, and a cord release position upon rotation of the latch member, said cord retaining seat being located proximate the axis of rotation of the latch member;

trigger means in said cavity including a trigger finger having one end fixed to the latch member and another end extended out of the trigger opening for digital engagement by an archer for rotation of the latch member from the cord retaining position to the cord release position, and;

handle means connected to the housing.

3. The bowstring release device of claim 2 including:

bias means acting on the trigger means to bias the trigger means to hold the latch member in the cord retaining position.

4. The bowstring release device of claim 3 wherein:

said bias means comprises a resilient ball located in said cavity, said trigger means having an arm extended rearwardly and in contact with said ball whereby said ball is compressed upon rotation of the trigger finger in a direction to move the latch member toward the cord release position.

5. The bowstring release device of claim 4 including:

a cord loop having fixed ends secured to said housing and a free end loop engagable with said shoulder of the latch member to form an intermediate loop for retaining a segment of bowstring.

6. The bowstring release device of claim 5 wherein:

said housing is generally cylindrical, said handle including a hose like member having one end attached to the rear of the housing and extending rearwardly therefrom.

7. The bowstring release device of claim 1 wherein:

said trigger means is movably associated with the latch member, said latch member including a catch, said trigger means including a sear movable into engagement with the catch when the latch member is in the cord retaining position to inhibit rotation of the latch member, and movable out of engagement with the catch upon movement of the trigger finger to permit rotation of the latch member to the cord release position.

8. The bowstring release device of claim 7 wherein:

said trigger means is pivotally assembled in the cavity and including bias means acting on the trigger means to bias the sear in engagement with the catch on the latch member.

9. The bowstring release device of claim 8 wherein:

said bias means comprises a resilient ball located in said cavity, said trigger means having an arm extended outwardly and in contact with said ball whereby said ball is compressed upon rotation of the trigger finger in a direction to move the cord retaining seat toward the cord release position.

10. A bowstring release device useable by an archer in conjunction with an arrow and a bowstring mounted on a bow to effect release of the bowstring to discharge the arrow along an intended forward longitudinal path of travel, said device comprising:

a housing having interior walls defining an interior cavity with a trigger opening and a latch opening;

a latch member having a generally flat central base located in the cavity for rotation about an axis generally perpendicular to the intended longitudinal path of travel of the arrow and having a generally segmented circular arcuate rib outwardly extended from both sides of the base in a direction parallel to said axis of rotation;

said interior walls defining said cavity shaped to closely conform to the latch member and having arcuate grooves on both sides of the base corresponding in shape to the path of travel of the arcuate rib upon rotation of the latch member, said rib of the latch member being supported and movably located in said grooves for rotation of the latch member about an axis generally perpendicular to the intended longitudinal path of travel of the arrow;

said latch member having a generally rearwardly facing shoulder accessible through the latch opening defining a cord retaining seat rotatable between a cord retaining position and a cord release position upon rotation of the latch member;

a trigger assembled in said cavity movably associated with the latch member and having a trigger finger extended through the trigger opening for engagement and movement by an archer, said latch member including a catch, said trigger including a sear movable into engagement with the catch when the latch member is in the cord retaining position to inhibit rotation of the latch member, and movable out of engagement with the catch upon movement of the trigger finger to permit rotation of the latch member to the cord release position.

11. The bowstring release device of claim 10 including:

means pivotally assembling the trigger in the cavity and bias means acting on the trigger to bias the trigger to hold the latch member in the cord retaining position.

12. The bowstring release device of claim 11 wherein:

said bias means comprises a resilient ball located in the cavity, said trigger having an outwardly extended arm in contact with said ball whereby said ball is compressed upon rotation of the trigger in a direction to move the latch member toward the cord release position.

13. The bowstring release device of claim 10 or 12 wherein:

said housing is generally cylindrical and including a handle, said handle including a hose like member attached to the rear of the housing and extending rearwardly therefrom.

14. The bowstring release device of claim 13 including:

a cord loop having fixed ends secured to said housing and a free end loop engageable with said shoulder of the latch member to form an intermediate loop for retaining a segment of bowstring.

15. The bowstring release device of claim 10 including:

a cord loop having fixed ends secured to said housing and a free end loop engagable with said shoulder of the latch member to form an intermediate loop for retaining a segment of bowstring.

16. The bowstring release device of claim 10 or 11 including:

means to adjust the amount of movement of the trigger needed to move the sear of the trigger out of engagement with the catch of the latch member to permit rotation of the latch member to the cord release position.

17. The bowstring release device of claim 16 wherein:

said means to adjust the amount of movement of the trigger needed to move the sear of the trigger out of engagement with the catch of the latch member includes a set screw adjustably threaded through the housing into the cavity with an interior end in bearing relationship to a portion of the trigger when the trigger is holding the latch member in the cord retaining position.

18. A bowstring release device useable by an archer in conjunction with an arrow and a bowstring mounted on a bow to effect release of the bowstring to discharge the arrow along an intended forward longitudinal path of travel, said device comprising:

a housing having interior walls defining an interior cavity with a trigger opening and a latch opening;

a latch member located in the cavity and comprised as a segmented circular member having a flat central web and a peripheral outwardly extended segmented arcuate lateral rib extending in perpendicular relationship to the plane of the web;

said interior walls defining said cavity having arcuate grooves corresponding in shape to the arcuate rib on the latch member, said rib of the latch member being movably located in said grooves for rotation of the latch member about an axis generally perpendicular to the intended longitudinal path of travel of the arrow;

said latch member having a generally rearwardly facing shoulder accessable through the latch opening defining a cord retaining seat rotatable between a cord retaining position and a cord release position upon rotation of the latch member;

a trigger assembled in said cavity movably associated with the latch member and having a trigger finger extended through the trigger opening for engagement and movement by an archer, said latch member including a catch outwardly extended from the rib, said trigger including a sear movable into engagement with the catch when the latch member is in the cord retaining position to inhibit rotation of the latch member, and movable out of engagement with the catch upon movement of the trigger finger to permit rotation of the latch member to the cord release position.

19. A bowstring release device useable by an archer in conjunction with an arrow and a bowstring mounted on a bow to effect release of the bowstring to discharge the arrow along an intended forward longitudinal path of travel, said device comprising:

a housing having interior walls defining an interior cavity with a trigger opening and a latch opening;

a latch member located in the cavity and having an arcuate lateral rib;

said interior walls defining said cavity having arcuate grooves corresponding in shape to the arcuate rib on the latch member, said rib of the latch member being movably located in said grooves for rotation of the latch member about an axis generally perpendicular to the intended longitudinal path of travel of the arrow;

said latch member having a generally rearwardly facing shoulder extended through the latch opening defining a cord retaining seat rotatable between a cord retaining position and a cord release position upon rotation of the latch member;

a trigger assembled in said cavity movably associated with the latch member and having a trigger finger extended through the trigger opening for engagement and movement by an archer, said latch member including a catch, said trigger including a sear movable into engagement with the catch when the latch member is in the cord retaining position to inhibit rotation of the latch member, and movable out of engagement with the catch upon movement of the trigger finger to permit rotation of the latch member to the cord release position;

said trigger having a central portion fixed in the cavity, said sear comprised as an elongate flexible member extended from the central portion of the trigger to the latch member with the end of said positionable in holding relationship to the catch when the latch member is in the bowstring retaining position, said trigger finger comprising an elongate flexible member extended from the central portion of the trigger through the trigger opening whereby rearward flexure of the trigger finger results in deflection of the end of the sear to move it out of engagement with the catch of the latch member.

20. The bowstring release device of claim 19 wherein:

said housing is generally T-shaped having a body portion and a handle portion, said handle portion including first and second oppositely extending lateral arms each having a finger engaging contour to be grasped by an archer.

21. A bowstring release device useable by an archer in conjunction with an arrow and a bowstring mounted on a bow to effect release of the bowstring to discharge the arrow along an intended forward longitudinal path of travel, said device comprising:

a housing having interior walls defining an interior cavity with a trigger opening and a latch opening, said housing being generally T-shaped having a body portion and a handle portion, said handle portion including first and second oppositely extending lateral arms each having a finger engaging contour to be grasped by an archer;

a latch member located in the cavity and having an arcuate lateral rib;

said interior walls defining said cavity having arcuate grooves corresponding in shape to the arcuate rib on the latch member, said rib of the latch member being movably located in said grooves for rotation of the latch member about an axis generally perpendicular to the intended longitudinal path of travel of the arrow;

said latch member having a generally rearwardly facing shoulder extended through the latch opening defining a cord retaining seat rotatable between a cord retaining position and a cord release position upon rotation of the latch member;

a trigger assembled in said cavity movably associated with the latch member and having a trigger finger extended through the trigger opening for engagement and movement by an archer, said latch member including a catch, said trigger including a sear movable into engagement with the catch when the latch member is in the cord retaining position to inhibit rotation of the latch member, and movable out of engagement with the catch upon movement of the trigger finger to permit rotation of the latch member to the cord release position;

said latch member being located in said cavity in the body portion, said latch opening being open to body portion, said cavity including a first passage extending rearwardly through the body portion to the handle portion, a second passage extending through the first arm and open at the end of said first arm at said trigger opening, said trigger having a central portion fixed at the intersection of the first passage and the second passage in the cavity, said sear comprised as an elongate flexible member extended from the central portion of the trigger to the latch member through said first passage with the end of said sear positionable in holding relationship to the catch when the latch member is in the bowstring retaining position, said trigger finger comprising an elongate flexible member extended from the central portion of the trigger through said second passage and extending outward of the trigger opening whereby rearward flexure of the trigger finger results in deflection of the end of the sear to move it out of engagement with the catch on the latch member.

22. The bowstring release device of claim 21 including:

a third passage extended through the second arm from the intersection of the first and second passages, a leg extended from the central portion of the trigger into said third passage, said leg being deflectable upon deflection of the trigger finger and positioned to intercept a sidewall of the housing defining said third passage upon a predetermined amount of deflection of the trigger finger.

23. The bowstring release device of claim 22 including:

means to adjust the amount of movement of the trigger needed to move the sear of the trigger out of engagement with the catch of the latch member to permit rotation of the latch member to the cord release position.

24. The bowstring release device of claim 22 including:

means to adjust the amount of movement of the trigger finger needed to move the sear of the trigger out of engagement with the catch of the latch member including a set screw adjustably threaded through the housing into the third passage with an interior end in bearing relationship to the leg of the trigger extending through said third passage when the trigger is holding the latch member in the cord retaining position.

25. The bowstring release device of claim 19, 20, or 21 wherein:

said latch member is comprised as a segmented circular member having a flat central web and a peripheral outwardly extended segmented arcuate lateral rib extending in perpendicular relationship to the plane of the web, said catch being outwardly extended from said rib.

26. The bowstring release device of claim 18 including:

means pivotally assembling the trigger in the cavity and bias means acting on the trigger to bias the trigger to hold the latch member in the cord retaining position.

27. The bowstring release device of claim 26 wherein:

said bias means comprises a resilient ball located in the cavity, said trigger having an outwardly extended arm in contact with said ball whereby said ball is compressed upon rotation of the trigger in a direction to move the latch member toward the cord release position.

* * * * *

UNITED STATES PATENT AND TRADEMARK OFFICE

CERTIFICATE OF CORRECTION

PATENT NO. : 4,391,263

DATED : July 5, 1983

INVENTOR(S) : Paul A. Dodge

It is certified that error appears in the above-identified patent and that said Letters Patent is hereby corrected as shown below:

Column 2, line 38, "defined" should be -- define --.

Column 4, line 47, after "has" delete -- a --.

Column 11, line 27, after "said" insert -- sear --.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*